US008653923B2

(12) United States Patent
Ramezanian et al.

(10) Patent No.: US 8,653,923 B2
(45) Date of Patent: Feb. 18, 2014

(54) SOLENOID SWITCH

(75) Inventors: Houman Ramezanian, Ennetbaden (CH); Ingo Richter, Markgroeningen (DE); Henning Stoecklein, Eberdingen (DE); Michael Froehlich-Schlapp, Rheinfelden (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 13/126,217

(22) PCT Filed: Oct. 27, 2009

(86) PCT No.: PCT/EP2009/064101

§ 371 (c)(1),
(2), (4) Date: Oct. 11, 2011

(87) PCT Pub. No.: WO2010/049400

PCT Pub. Date: May 6, 2010

(65) Prior Publication Data

US 2012/0019340 A1 Jan. 26, 2012

(30) Foreign Application Priority Data

Oct. 27, 2008 (DE) ..... 10 2008 043 191

(51) Int. Cl.
*H01F 7/00* (2006.01)
*H01F 3/00* (2006.01)

(52) U.S. Cl.
USPC ..... 335/278; 335/260

(58) Field of Classification Search
USPC ..... 335/260, 278
See application file for complete search history.

(56) References Cited

U.S. PATENT DOCUMENTS 4,887,056 A 12/1989 Kajino et al.
5,126,712 A 6/1992 Sugiyama

FOREIGN PATENT DOCUMENTS

FR 817068 A 8/1937
GB 2265493 9/1993

OTHER PUBLICATIONS

PCT/EP2009/064101 International Search Report.

*Primary Examiner* — Ramon Barrera
(74) *Attorney, Agent, or Firm* — Michael Best & Friedrich LLP

(57) ABSTRACT

The invention relates to a solenoid switch for starting devices for starting internal combustion engines, comprising a joint (100) between assembled parts of the solenoid switch. The invention is characterized in that the joint is formed in such a way that a direct penetration of spray water is prevented and pressure compensation is enabled.

19 Claims, 9 Drawing Sheets

SOLENOID SWITCH

BACKGROUND OF THE INVENTION

Starters that are used for starting internal combustion engines require currents up to 3000 A. Said currents are switched via an electromagnetic switch.

The magnetic armature, as claimed in the prior art, is drawn in by a magnetic field which is generated in the magnetic field windings and presses the switching axis with the contact bridge onto the contacts in the switch cover. This closes the connection between the battery and the electric motor of the starter. In the case of corresponding demands, the relay can be protected against ingress of water and other media from the surrounding area by means of a protective cap produced from an elastomer. Where a rapid increase in the temperature of the relay is caused by the motor, e.g. by traveling at high load (tow load or speed load) or by a rapid drop in atmospheric pressure caused by traveling uphill, the air in the relay expands, the protective cap swells and the relay is possibly no longer able to switch. This means that the functioning of the starter is no longer certain.

It is known from the prior art to admit a hole several millimeters large into the protective cap in order to ensure pressure compensation. However, media such as water or dirt are also able to penetrate into or emerge from the relay via said hole.

Between the core and the switch cover there is usually another cup spring. A seal is obtained in a circumferential manner in the region between the protective cap and the fixed magnetic core by the bead of the protective cap being pressed onto the relay housing by means of a retaining ring (not shown in the drawing).

DETAILED DESCRIPTION

Figure 1:
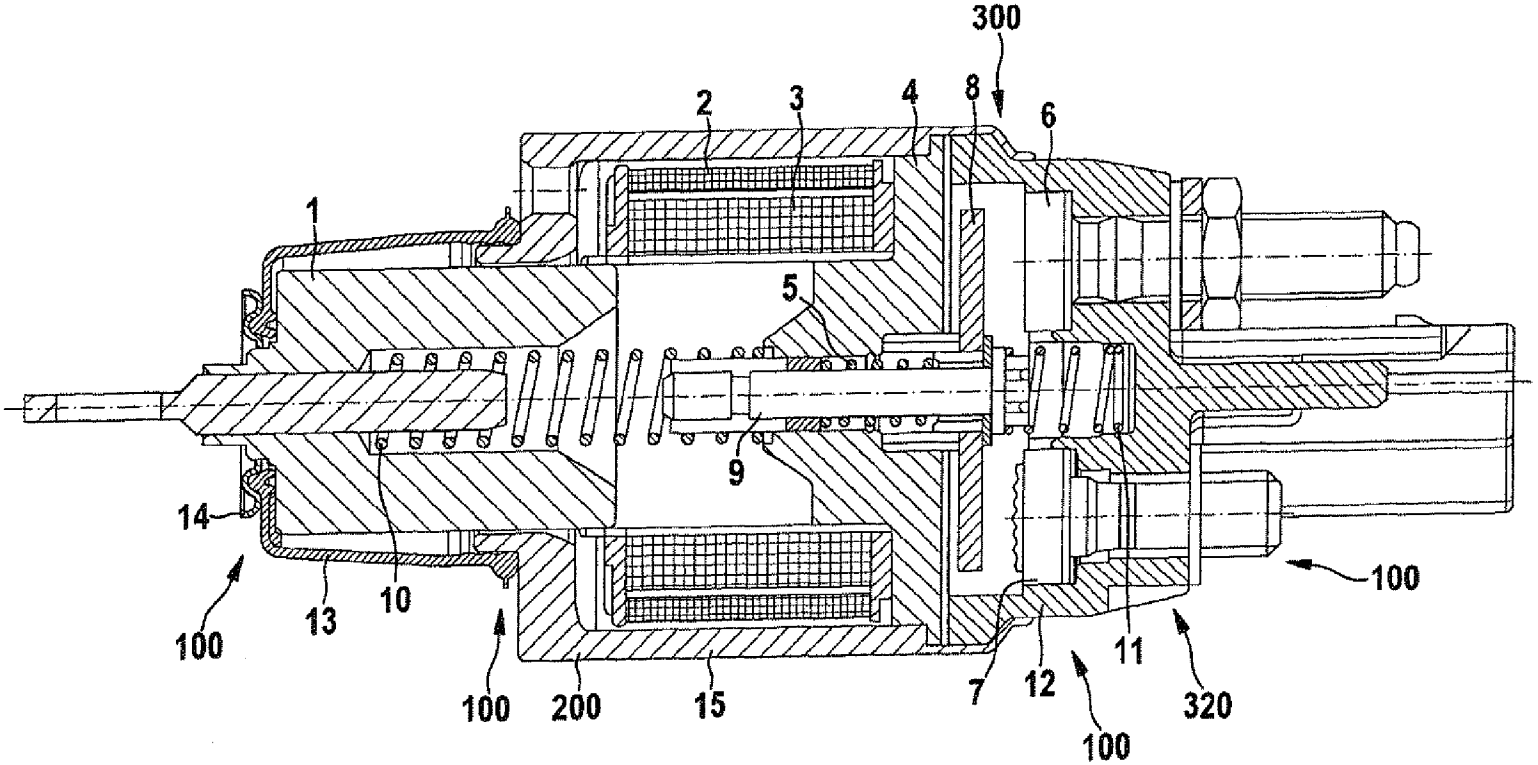
FIG. 1 shows a cross-sectional view of the solenoid switch according to an exemplary embodiment of the invention.

By installing a gap (straight or non-straight, e.g. curved, angular, several changes in direction) at the joints of the relay (e.g. in the protective cap (13), the relay cover (in the region of B at part 12), the plain washers of the terminal screws (region C between part 6 or 7 and part 12) or between the armature (1) and the driver (21) in the region D), the excess pressure in the relay is able to escape in a targeted manner. This means that the functioning of the relay can be ensured even after a rapid rise in temperature. The solution proposed here offers sufficient protection against spray water as only gaps with a small cross section are used and/or a media flow has to change direction several times in order to penetrate into the relay.

Tests have shown that the tightness of starter relays with a protective cap varies greatly through fluctuations in the tolerances. In measurements of the draw-in potential after a rapid rise in temperature (the temperature has been increased from 20° C. to 130° C. within 15 min), values between 8.5 V and 24 V have been measured; from a value above 10 V there is a risk of failure because the moveable magnetic armature would no longer be able to be drawn in. By building-in of a slight leakage, pressure reduction can be achieved and the draw-in potential after a rapid rise in temperature is certainly less than 9.5 V. At the same time, no spray water is able to penetrate into the relay on account of the protective cap as claimed in the invention.

Figure 2:
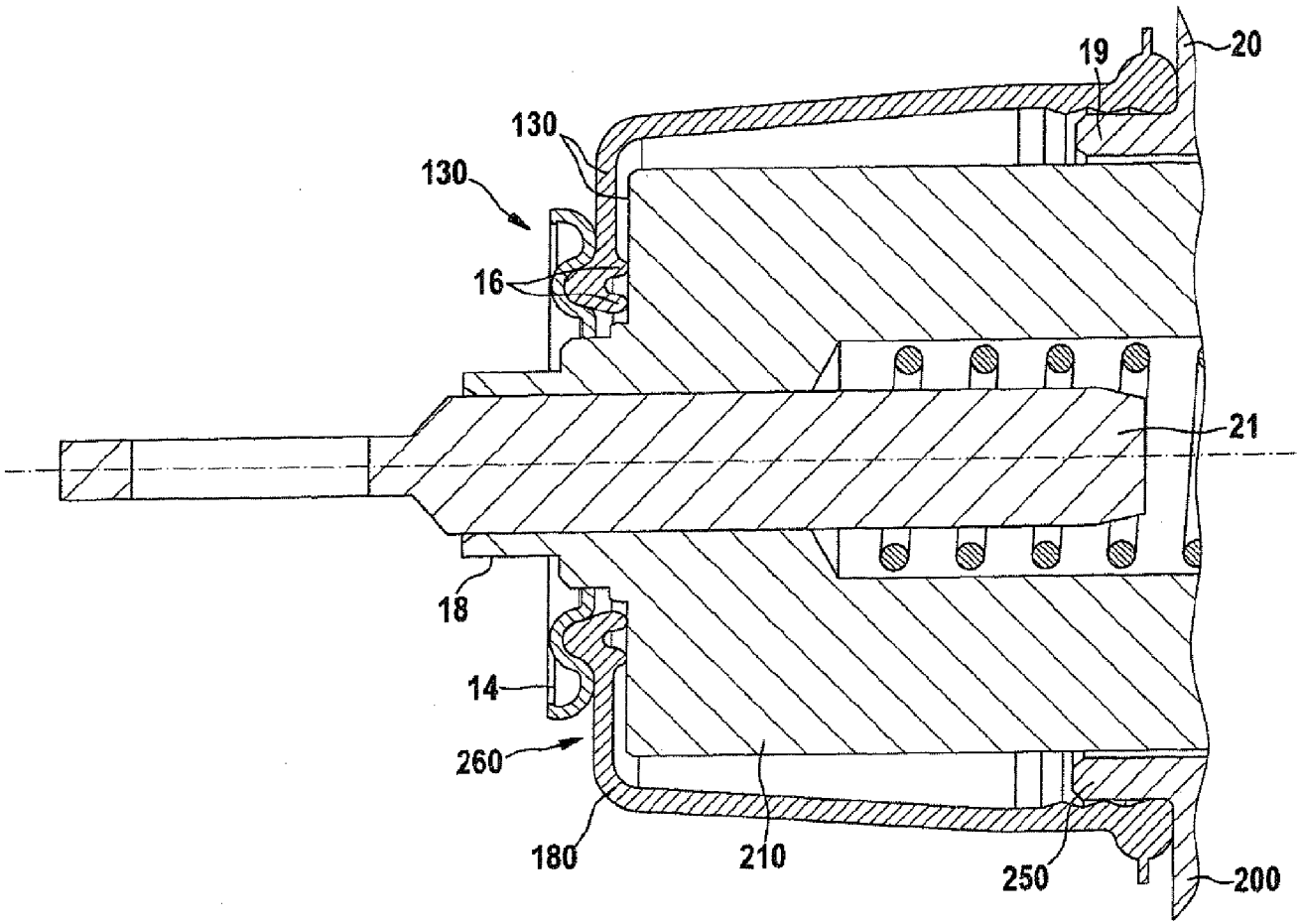
FIG. 2 shows a partial view of the solenoid switch of FIG. 1.

In the case of current protective caps, the seal to the relay armature is obtained by means of two concentric beads (functioning as sealing rings, see no. 16 in FIG. 2) in the protective cap which are pressed onto the armature by a calking disk (no. 14 in FIG. 2).

Figure 6:
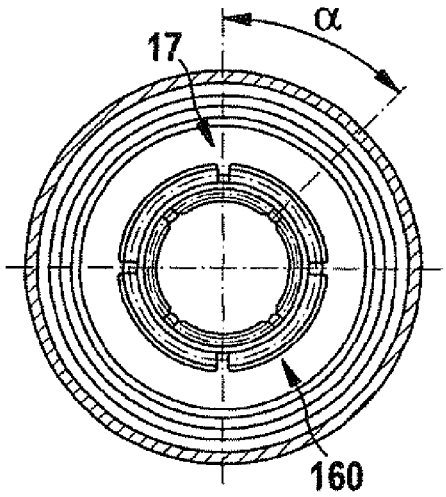
FIG. 6 shows an alternative embodiment of the cap of FIG. 4 having four breaks in each of its sealing rings.

In order to enable an exchange of air, the protective cap as claimed in the invention has in each case 4 breaks in the sealing rings which are offset symmetrically in relation to each other and thus form a labyrinth (see FIG. 6). The intermediate spaces between the ring segments are certainly greatly reduced through the pinching process, nevertheless sufficient pressure compensation between the interior and the exterior is still possible. Contrary to other embodiments where an exchange of media between the interior and the exterior of the relay is possible on a direct path (e.g., hole in the rubber bellows), media have to change direction many times in the case of this protective cap in order to pass through the labyrinth. This means that sufficient protection against spray water is obtained.

The embodiment of the protective cap as claimed in the invention has, for example, per sealing ring 4 recesses/openings (170) which are distributed uniformly over the periphery and are offset in relation to the other sealing ring by alpha=45°.

It is conceivable to insert a rib structure similar to that in the rubber protective cap also into the calking disk in order to obtain a better exchange of air in this way. However, it must also be taken into account here that more water can also penetrate into the relay.

Figure 3:
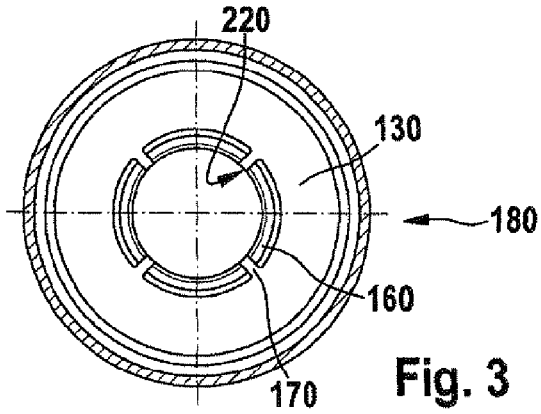
FIG. 3 shows a protective cap according to an exemplary embodiment of the invention.
Figure 7:
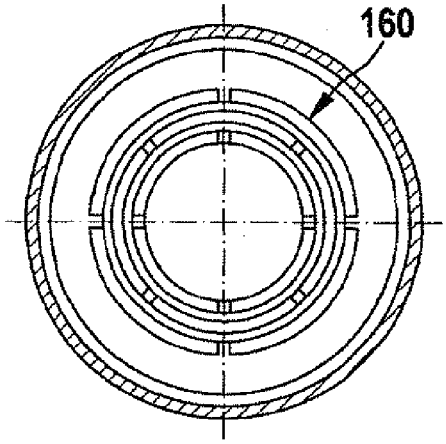
FIG. 7 shows an alternative embodiment of the cap of FIG. 3 having three sealing rings.

Variants:

Number of sealing rings between fixing and relay armature between 1 and 5 (FIG. 3, as an example, showing one sealing ring and FIG. 7, as an example, showing 3 sealing rings).

Figure 4:
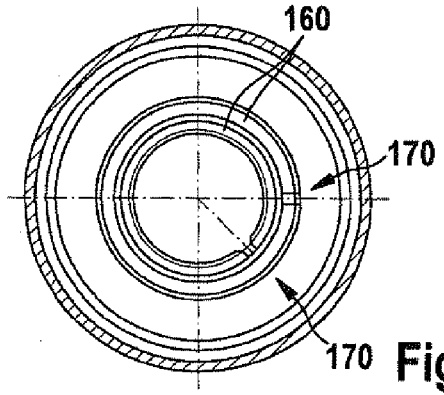
FIG. 4 shows an alternative embodiment of the cap of FIG. 3 having two sealing rings and one break in each of its sealing rings.
Figure 5:
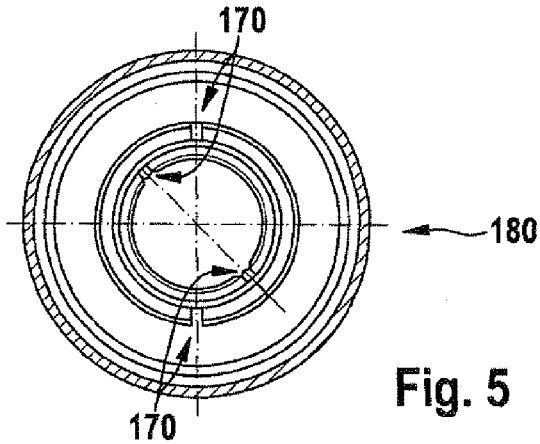
FIG. 5 shows an alternative embodiment of the cap of FIG. 4 having two breaks in each of its sealing rings.

Number of breaks per sealing ring between 1 and 8. As an example, for two sealing rings in each case variants are shown with one (see FIG. 4) and two (see FIG. 5) breaks.

The number of breaks is independent of the number of sealing rings; combinations of two variants are possible.

The angle between the breaks per sealing ring is arbitrary and does not have to be identical for all.

In the case of more than one sealing ring, the offset angle alpha between the breaks on different sealing rings is arbitrary and does not have to be identical for all breaks.

Figure 8A:
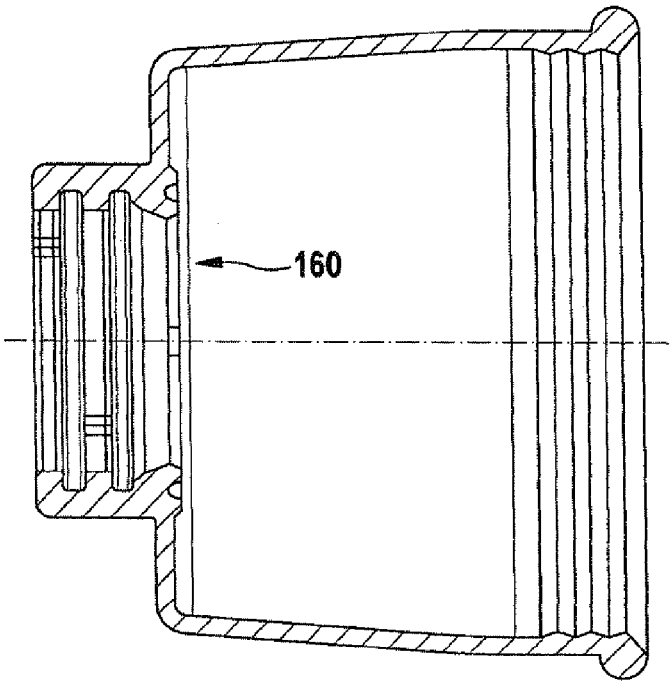
FIGS. 8*a* and 8*b* show an alternative embodiment of the cap of FIG. 1 having a seal at the neck of the relay armature.
Figure 8B:
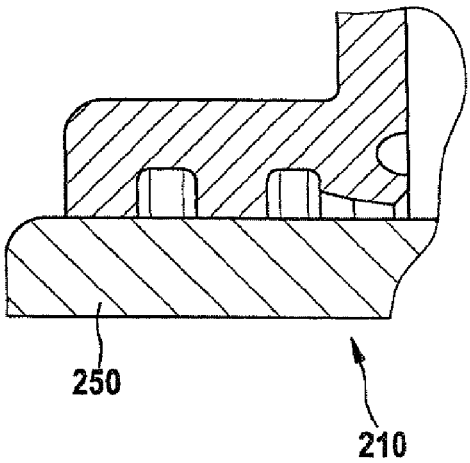

The sealing rings and the breaks therein do not have to be between fixing (e.g. calking disc) and armature end face. It is also conceivable to obtain the seal at the neck of the relay armature (no. 18 in FIG. 2, or FIG. 8). As an example, a variant with 3 sealing rings and 1 break each is shown here.

In the case of this type of seal, all variants are possible, i.e. variation in the number of sealing rings and variation in the number and arrangement of breaks.

Figure 9A:
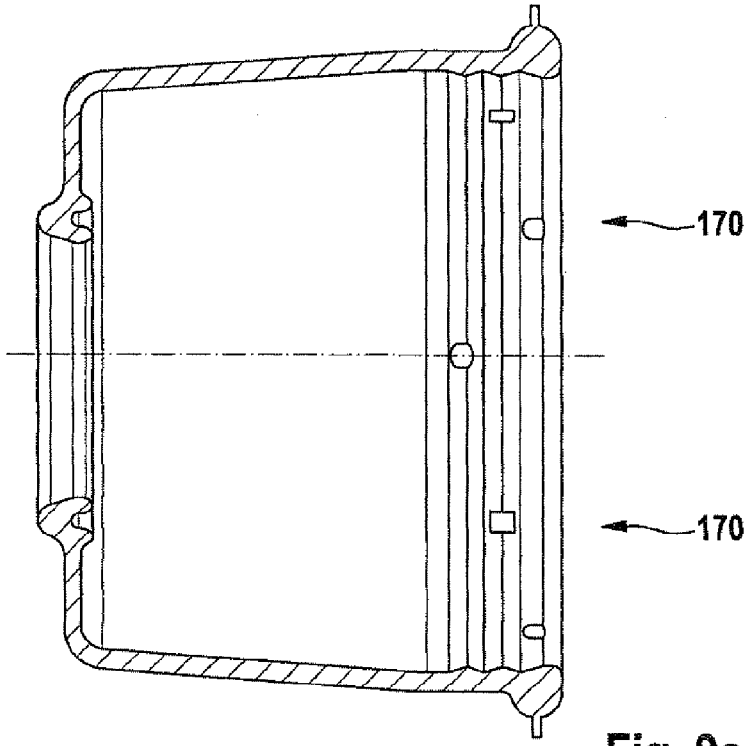
FIGS. 9*a* and 9*b* show an alternative embodiment of the protective cap of FIG. 1 in the region of the neck of the relay housing having three rings with two breaks each.
Figure 9B:
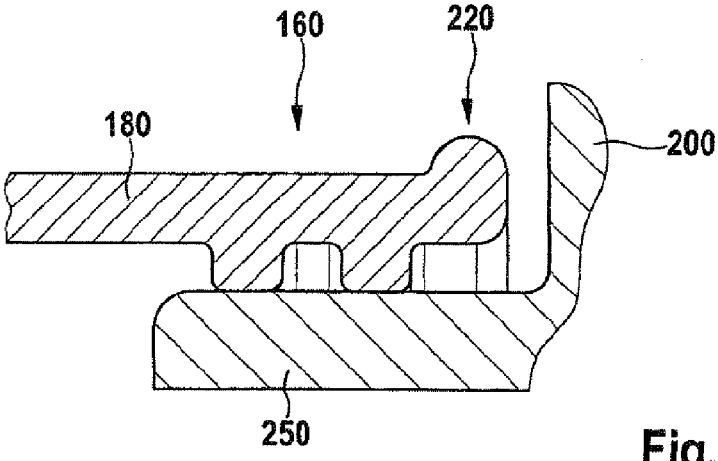
Figure 10A:
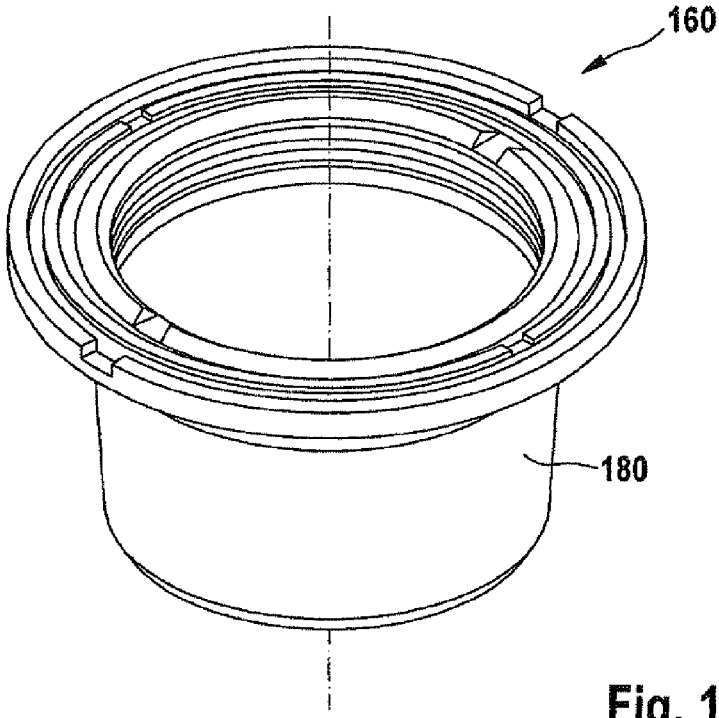
FIGS. 10*a* and 10*b* show an alternative embodiment of the cap of FIG. 1 in the region of the end face of the relay housing having three rings with two breaks each.
Figure 10B:
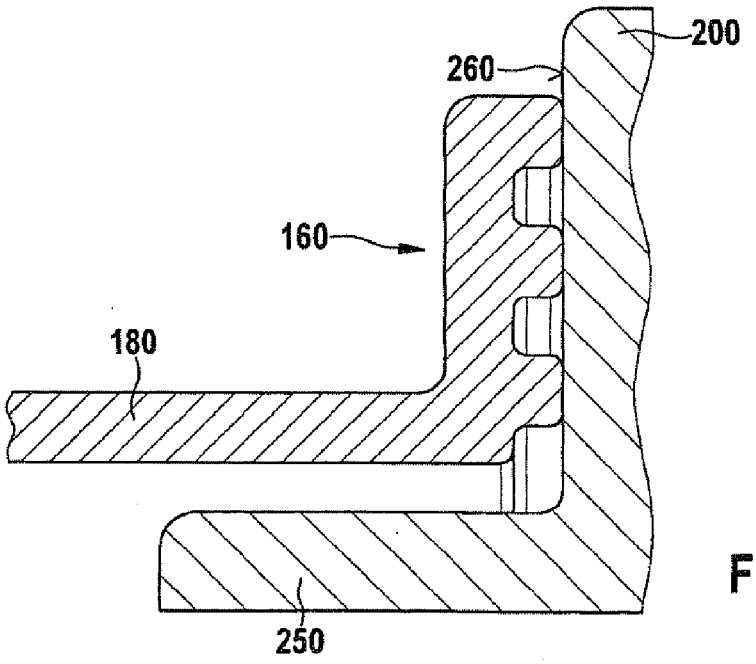

The ventilation of the relay is effected via a break in the protective cap in the region of the neck of the relay housing (no. 19 in FIG. 2, or 250 in FIGS. 9 and 10). Here too, all variants are possible, i.e. variation in the number of sealing rings and variation in the number and arrangement of the breaks. As an example, a variant with 3 rings and 2 breaks each is shown in FIG. 9.

The break in the seal is effected in the region of the end face of the relay housing (no. 20 in FIG. 2). Here too, all variants are possible, i.e. variation in the number of sealing rings and variation in the number and arrangement of the breaks. As an example, a variant with 3 rings and 2 breaks each is shown in FIG. 10.

The cross-sectional form of the sealing rings is arbitrary. As an example, round, wave-like cross sections are shown in FIG. 2, rectangular forms in FIG. 9. Saw tooth-like forms are also conceivable.

The breaks are not situated in the protective cap, but rather in the fixing, e.g. the calking disk (fixing on armature) or the retaining disk (fixing on relay housing). The breaks can be placed in position in a manner similar to in the protective cap. All variants are possible in this case too, i.e. variation in the number of sealing rings and variation in the number and arrangement of the breaks.

Figure 11:
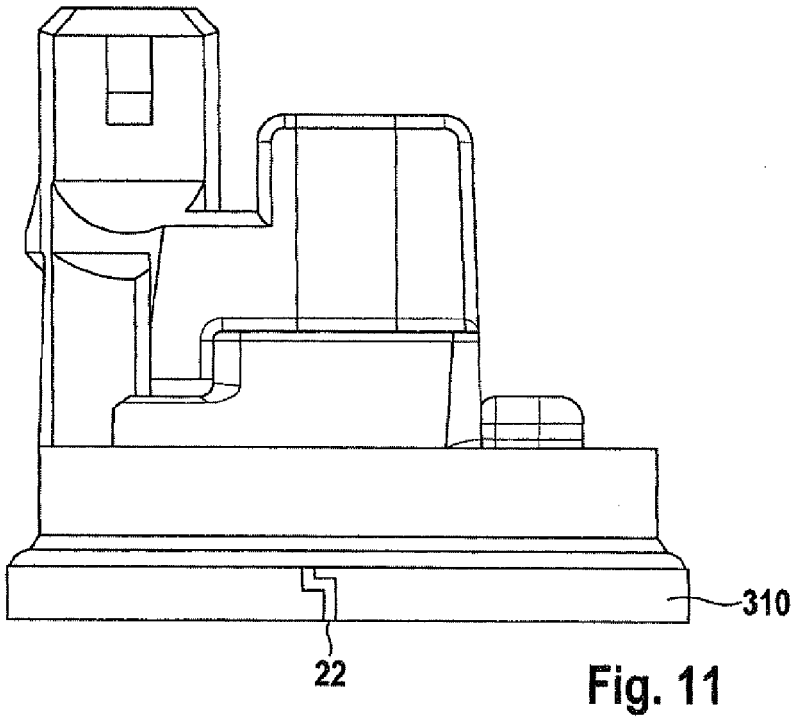
FIG. 11 shows an embodiment of the relay cover with a channel with 2 direction changes.

FIG. 11: A channel is inserted into the relay cover (12) in the region of the bead edge (B). Said channel can have an arbitrary cross-sectional form (e.g. rectangular, triangular, rounded-off) and can extend in a straight manner or a non-straight manner. In the case of the channel being guided in a non-straight manner, said channel can extend in a swung/curved or even angular manner. Several direction changes are also possible. FIG. 11, as an example, shows an embodiment with a channel with 2 direction changes. Along with the form of the channel, it is also possible to vary the number of channels between one and 8.

Figure 12A:
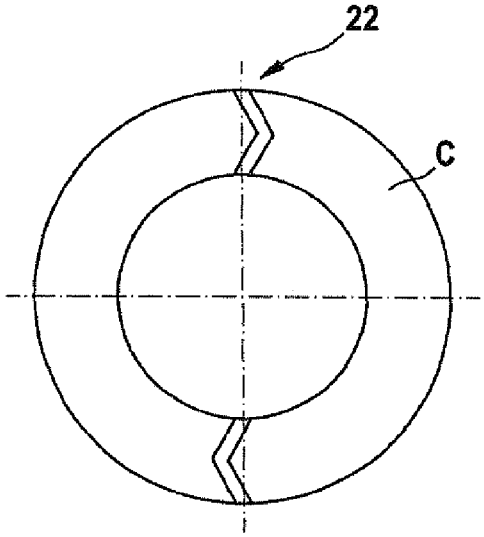
FIGS. 12*a* and 12*b* show a gasket forming a seal between the contact stud and the relay cover according to an exemplary embodiment of the invention.
Figure 12B:
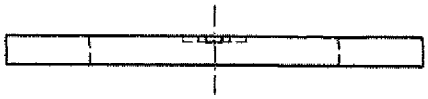

FIG. 12: In the case of the current relay, a seal between the contact stud (6 and 7) and the relay cover is obtained by means of a gasket in the region C. One to eight gaps can be inserted into said gasket. Said gaps can extend through the entire cross section of the gasket (e.g. as slotted washer) or can be realized as an indentation. Such a gasket can be used at one of the contact studs or at both contact studs. The form of the gap can have all the variants described in point 11. FIG. 12 shows, as an example, a gasket with 2 gaps each with 2 direction changes.

Figure 13A:
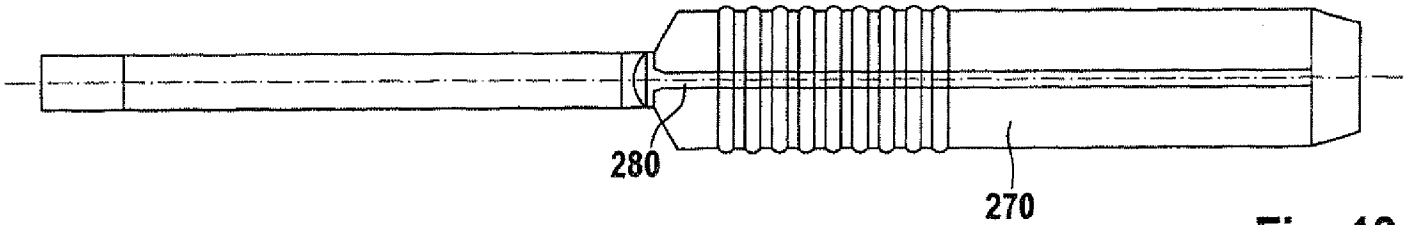
FIGS. 13*a* and 13*b* show a gap inserted into the joint between relay armature and driver according to an exemplary embodiment of the invention.
Figure 13B:
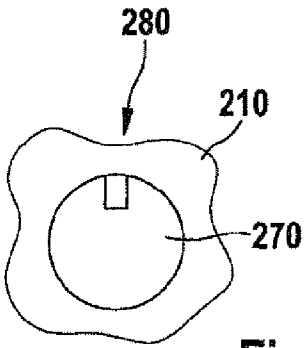

FIG. 13: A gap can also be inserted into the joint between relay armature (1) and driver (21) in the region D. The gap can have all the variants described. FIG. 13, as an example, shows a linear gap without any direction change (23) in the driver.

The invention claimed is:

1. A solenoid switch for starting devices for starting internal combustion engines, said solenoid switch comprising:

a joint between assembled parts of the solenoid switch, characterized in that the joint is developed in such a manner that, on the one hand, direct penetration of spray water is prevented and, on the other hand, pressure compensation through the joint is made possible; and a resilient protective cap that covers the joint between a fixed magnetic core and a moveable magnetic core, wherein a terminal edge of the protective cap at said joint includes a wall structure having an opening.

2. The solenoid switch as claimed in claim 1, characterized in that the joint is arranged between at least two walls, wherein in the joint one wall has a wall structure which borders onto the other wall and the wall structure has an opening which makes pressure compensation through the joint possible.

3. The solenoid switch as claimed in claim 1, wherein the protective cap abuts at least directly against the moveable magnetic core by way of the edge.

4. The solenoid switch as claimed in claim 1, wherein the protective cap abuts at least directly against the fixed magnetic core by way of the edge.

5. The solenoid switch as claimed in claim 1, characterized in that the wall structure has a plurality of openings.

6. The solenoid switch as claimed in claim 1, characterized in that the wall structure is adjoined by at least one further wall structure, wherein said further wall structure also has at least one opening.

7. The solenoid switch as claimed in claim 1, characterized in that the at least one wall structure abuts against a neck or an end face of the fixed or moveable magnetic core by way of a wall edge.

8. The solenoid switch as claimed in claim 1, characterized in that there is a pressure between the edge and a pressure element, wherein, there is a pressure also between the wall structure and an end face of the moveable magnetic core.

9. The solenoid switch as claimed in claim 1, characterized in that a switching axis is arranged in an opening of the moveable magnetic core, wherein the switching axis, where it is longer than the length of the switching axis extending into the opening, has a smaller cross section than the opening.

10. The solenoid switch as claimed in claim 9, characterized in that the switching axis is slotted and pressure compensation is possible via the slot.

11. The solenoid switch as claimed in claim 1, characterized in that between a switch space, in which a contact bridge is arranged, and the surrounding area of the solenoid switch is a joining point between a switch cover and the housing, wherein a channel is integrally formed in the joining point.

12. The solenoid switch as claimed in claim 11, characterized in that the channel is admitted in a retaining bead of the switch cover.

13. The solenoid switch as claimed in claim 1, characterized in that between a switching space, in which the contact bridge is arranged, and the passage of a stud of the solenoid switch is a joining point, wherein a channel is integrally formed in the joining point.

14. The solenoid switch as claimed in claim 13, characterized in that a washer C has a channel between a stud head and a portion of the switch cover.

15. The solenoid switch as claimed in claim 11, characterized in that the channel has an angled development.

16. The solenoid switch as claimed in claim 1, characterized in that the wall structure abuts against a neck or a circular end face of the fixed or moveable magnetic core by way of a wall edge.

17. The solenoid switch as claimed in claim 1, characterized in that there is a pressure between the edge and a pressure element, wherein, on account of this, there is a pressure also between the wall structure and an end face of the moveable magnetic core.

18. A solenoid switch for starting devices for starting internal combustion engines, said solenoid switch comprising:

a joint between assembled parts of the solenoid switch, characterized in that the joint is developed in such a manner that, on the one hand, direct penetration of spray water is prevented and, on the other hand, pressure compensation through the joint is made possible characterized in that a resilient protective cap covers a joint between a fixed magnetic core and a moveable magnetic core, wherein the protective cap abuts at least directly against the moveable magnetic core by way of an edge, wherein a wall structure is arranged at the edge, wherein the wall structure has at least one opening, and characterized in that the wall structure is adjoined by at least one further wall structure, wherein said further wall structure also has at least one opening and said opening of said further wall structure is arranged, with regard to an axis of movement of the moveable magnetic core, at another circumferential position relative to the opening of the wall structure.

19. A solenoid switch for starting devices for starting internal combustion engines, said solenoid switch comprising:

a joint between assembled parts of the solenoid switch, characterized in that the joint is developed in such a manner that, on the one hand, direct penetration of spray water is prevented and, on the other hand, pressure compensation through the joint is made possible characterized in that a resilient protective cap covers a joint between a fixed magnetic core and a moveable magnetic core, wherein the protective cap abuts at least directly against the fixed magnetic core by way of an edge, wherein a wall structure is arranged at the edge, wherein the wall structure has at least one opening, and characterized in that the wall structure is adjoined by at least one further wall structure, wherein said further wall structure also has at least one opening and said opening of said further wall structure is arranged, with regard to an axis of movement of the moveable magnetic core, at another circumferential position relative to the opening of the wall structure.

* * * * *

UNITED STATES PATENT AND TRADEMARK OFFICE

CERTIFICATE OF CORRECTION

PATENT NO. : 8,653,923 B2
APPLICATION NO. : 13/126217
DATED : February 18, 2014
INVENTOR(S) : Ramezanian et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 59 days.

Signed and Sealed this
Twenty-ninth Day of September, 2015

Michelle K. Lee

Michelle K. Lee
*Director of the United States Patent and Trademark Office*